US010226858B2

(12) United States Patent
Dostinov et al.

(10) Patent No.: US 10,226,858 B2
(45) Date of Patent: Mar. 12, 2019

(54) DEMOLITION HAMMER WITH WEAR PLATE SYSTEM HAVING DEBRIS CHANNELS

(71) Applicant: Caterpillar Inc., Peoria, IL (US)

(72) Inventors: Dimitar Dostinov, Fort Worth, TX (US); Rakesh Jagdale, Waco, TX (US)

(73) Assignee: Caterpillar Inc., Deerfield, IL (US)

( * ) Notice: Subject to any disclaimer, the term of this patent is extended or adjusted under 35 U.S.C. 154(b) by 908 days.

(21) Appl. No.: 14/628,920

(22) Filed: Feb. 23, 2015

(65) Prior Publication Data

US 2016/0184982 A1 Jun. 30, 2016

Related U.S. Application Data

(60) Provisional application No. 62/097,453, filed on Dec. 29, 2014.

(51) Int. Cl.

| | |
|---|---|
| ***B25D 17/24*** | (2006.01) |
| ***B25D 17/00*** | (2006.01) |
| ***E02F 3/96*** | (2006.01) |

(52) U.S. Cl.

CPC ..... *B25D 17/00* (2013.01); *E02F 3/966* (2013.01); *B25D 2250/105* (2013.01); *B25D 2250/121* (2013.01); *B25D 2250/225* (2013.01)

(58) Field of Classification Search

CPC .. B25D 17/00; B25D 17/24; B25D 2250/225; B25D 2250/105; B25D 2250/121; E02F 3/966

See application file for complete search history.

(56) References Cited

U.S. PATENT DOCUMENTS

| | | | | |
|---|---|---|---|---|
| 5,188,303 | A | 2/1993 | Hoof | |
| 5,944,120 | A | 8/1999 | Barden | |
| 6,095,257 | A * | 8/2000 | Lee | B25D 17/24 173/162.1 |
| 7,628,222 | B2 * | 12/2009 | Yoshimura | E04G 23/082 173/162.1 |
| 8,061,450 | B2 | 11/2011 | Marshall | |
| 8,360,167 | B2 | 1/2013 | Jagdale et al. | |
| 8,672,052 | B2 * | 3/2014 | Nickels | E02F 3/966 173/128 |
| 8,689,940 | B2 | 4/2014 | Jagdale et al. | |

(Continued)

FOREIGN PATENT DOCUMENTS

| | | | |
|---|---|---|---|
| WO | WO 2014013466 A2 * | 1/2014 | E21B 1/02 |

*Primary Examiner* — Andrew M Tecco

(74) *Attorney, Agent, or Firm* — Leydig, Voit & Mayer, LTD.

(57) ABSTRACT

A demolition hammer includes a housing defining an interior cavity, a power cell having a front head, and a wear plate. The power cell is disposed within the interior cavity of the housing. The wear plate is interposed between the housing and the front head of the power cell. The wear plate includes a body defining a central longitudinal axis. The body has a face that includes a bottom end, a top end in spaced relationship to the bottom end along the central longitudinal axis, and a pair of lateral edges in spaced relationship to each other along a transverse axis that is perpendicular to the central longitudinal axis. The face includes an interface surface that defines at least one channel extending along the central longitudinal axis and that is in proximate relationship with the front head of the power cell.

14 Claims, 9 Drawing Sheets

(56) References Cited

U.S. PATENT DOCUMENTS

| | | | | |
|---|---|---|---|---|
| 9,630,308 | B2 * | 4/2017 | Nickels | E02F 3/966 |
| 9,821,447 | B2 * | 11/2017 | Robson | B25D 17/24 |
| 2012/0037389 | A1 | 2/2012 | Jagdale et al. | |
| 2012/0043163 | A1 | 2/2012 | Jagdale et al. | |
| 2012/0145424 | A1 * | 6/2012 | Nickels | E02F 3/966 173/90 |
| 2013/0081837 | A1 | 4/2013 | Jagdale et al. | |
| 2013/0240299 | A1 | 9/2013 | Jagdale et al. | |
| 2014/0102740 | A1 | 4/2014 | Jagdale et al. | |
| 2014/0208575 | A1 | 7/2014 | Jagdale et al. | |
| 2014/0219741 | A1 | 8/2014 | Fortner et al. | |
| 2015/0202763 | A1 * | 7/2015 | Robson | E21B 1/02 173/210 |

* cited by examiner

DEMOLITION HAMMER WITH WEAR PLATE SYSTEM HAVING DEBRIS CHANNELS

CROSS-REFERENCE TO RELATED APPLICATION

This patent application claims the benefit of priority to U.S. Patent Application No. 62/097,453, filed Dec. 29, 2014, and entitled "Demolition Hammer with Wear Plate System Having Debris Channels," which application is incorporated in its entirety herein by this reference.

TECHNICAL FIELD

This patent disclosure relates generally to a demolition hammer and, more particularly, to a demolition hammer including a wear plate system having debris channels.

BACKGROUND

A demolition hammer is frequently used at a work site to break apart things such as rock, concrete, asphalt, frozen ground, or other materials. The demolition hammer may be mounted to a machine, such as, a backhoe or an excavator, for example. Such hammers may include a pneumatically or hydraulically actuated power cell having an impact system operatively coupled to a tool that extends from the hammer to engage the object to be broken apart.

The power cell of a demolition hammer may be positioned within a housing and supported on buffers, which allow some relative movement between the power cell and the housing. A plurality of wear plates may be interposed between the power cell and the interior of the housing. For example, a hammer with a square housing may have four separate wear plates (front, back, right side, and left side) that surround a portion of the power cell.

In operation, a demolition hammers can be exposed to a lot of dust, dirt and other contaminants which tend to be abrasive. This abrasive material can infiltrate a gap between the tool and the lower bushing and enter the housing. The abrasive material that becomes stuck between the front head and the wear plates can cause wear of the front head of the hammer. The front head wear caused by this trapped debris can reduce the useful life of the demolition hammer and/or prevent the front head from being used for rebuilding the hammer. Furthermore, the movement of the power cell relative to the housing during operation can result in wear of the wear plates. Thus, the wear plates may need periodic replacement.

U.S. Pat. No. 8,061,450 is entitled, "Percussion Drilling Assembly Having Erosion Retarding Casing," and is directed to a percussion drilling assembly for drilling through earthen formations and forming a borehole. In some embodiments, the drilling assembly includes a retainer sleeve having an upper end with an outer diameter and a tubular casing engaging the retainer sleeve. The tubular casing includes a first, second, and third tubular portion. The first tubular portion engages the upper end of the retainer sleeve at a first end having an outer diameter substantially equal to the outer diameter of the retainer sleeve. The second tubular portion is connected to the first tubular portion at a first end and has a second end with an outer diameter that differs from the outer diameter of the retainer sleeve. The third tubular portion is coupled to the second tubular portion.

The first and third tubular portions each have a length configured to enable gripping of the tubular casing using tongs.

There is a continued need in the art to provide additional solutions for the reduction of the wear of the components of a demolition hammer as a result of the abrasive environment within which it is frequently operated. For example, there is a continued need for a demolition hammer solution to help reduce the wear of the front head caused by abrasive debris trapped between the wear plate and the front head.

It will be appreciated that this background description has been created by the inventors to aid the reader, and is not to be taken as an indication that any of the indicated problems were themselves appreciated in the art. While the described principles can, in some respects and embodiments, alleviate the problems inherent in other systems, it will be appreciated that the scope of the protected innovation is defined by the attached claims, and not by the ability of any disclosed feature to solve any specific problem noted herein.

SUMMARY

In an embodiment, the present disclosure describes a wear plate for a demolition hammer having a housing and a power cell. The wear plate is for being interposed between the housing and the power cell. The wear plate comprises a body defining a central longitudinal axis. The body includes a first face, a second face, and a pair of sidewalls.

The first face includes a first face bottom end, a first face top end in spaced relationship to the first face bottom end along the central longitudinal axis, and a pair of first face lateral edges in spaced relationship to each other along a transverse axis that is perpendicular to the central longitudinal axis. The second face includes a second face bottom end, a second face top end in spaced relationship to the second face bottom end along the central longitudinal axis, and a pair of second face lateral edges in spaced relationship to each other along the transverse axis. The first face and the second face are in spaced relationship to each other along a normal axis that is mutually perpendicular to the central longitudinal axis and the transverse axis. The pair of sidewalls respectively extends between the pair of first face lateral edges of the first face and the pair of second face lateral edges of the second face.

The first face includes a first interface surface. The first interface surface defines at least one first face channel extending along the central longitudinal axis.

In another embodiment, a demolition hammer is disclosed. The demolition hammer includes a housing, a power cell, and a wear plate.

The housing has an interior wall surface defining an interior cavity. The power cell is disposed within the interior cavity of the housing. The power cell includes a front head. The wear plate is interposed between the interior wall surface of the housing and the front head of the power cell.

The wear plate includes a body defining a central longitudinal axis. The body includes a first face, a second face, and a pair of sidewalls.

The first face includes a first face bottom end, a first face top end in spaced relationship to the first face bottom end along the central longitudinal axis, and a pair of first face lateral edges in spaced relationship to each other along a transverse axis that is perpendicular to the central longitudinal axis. The second face includes a second face bottom end, a second face top end in spaced relationship to the second face bottom end along the central longitudinal axis, and a pair of second face lateral edges in spaced relationship to each other along the transverse axis. The first face and the second face are in spaced relationship to each other along a normal axis that is mutually perpendicular to the central longitudinal axis and the transverse axis. The pair of sidewalls respectively extends between the pair of first face lateral edges of the first face and the pair of second face lateral edges of the second face.

The first face includes a first interface surface. The first interface surface defines at least one first face channel extending along the central longitudinal axis. The first interface surface is in proximate relationship with the front head of the power cell.

In yet another embodiment, a method of assembling a demolition hammer is provided. The method of assembling includes installing a power cell within an interior cavity defined by an interior wall surface of a housing. A wear plate is interposed between the interior wall surface of the housing and a front head of the power cell. The wear plate includes a body defining a central longitudinal axis. The body has a first face. The first face includes a first face bottom end, a first face top end in spaced relationship to the first face bottom end along the central longitudinal axis, and a pair of first face lateral edges in spaced relationship to each other along a transverse axis that is perpendicular to the central longitudinal axis. The first face includes a first interface surface. The first interface surface defines at least one first face channel extending along the central longitudinal axis. The first interface surface is in proximate relationship with the front head of the power cell.

Further and alternative aspects and features of the disclosed principles will be appreciated from the following detailed description and the accompanying drawings. As will be appreciated, the principles related to demolition hammers and wear plates for demolition hammers disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

It should be understood that the drawings are not necessarily to scale and that the disclosed embodiments are sometimes illustrated diagrammatically and in partial views. In certain instances, details which are not necessary for an understanding of this disclosure or which render other details difficult to perceive may have been omitted. It should be understood, of course, that this disclosure is not limited to the particular embodiments illustrated herein.

DETAILED DESCRIPTION

The present disclosure provides a wear plate system for a demolition hammer. In embodiments, the demolition hammer can be mounted to a machine. Examples of suitable machines include mobile or stationary machines used for construction, mining, farming, forestry, transportation, and other similar industries. In some embodiments, the machine can be an excavator, backhoe, dozer, load, motor grader, or any suitable off-highway vehicle. The demolition hammer can include a wear plate interposed between a housing and a front head of a power cell. The wear plate includes an interface surface which is in proximate relationship to the front head of the power cell and which defines a debris channel configured to help inhibit the wear of the front head caused by the debris positioned between the interface surface of the wear plate and the front head of the power cell.

Figure 1:
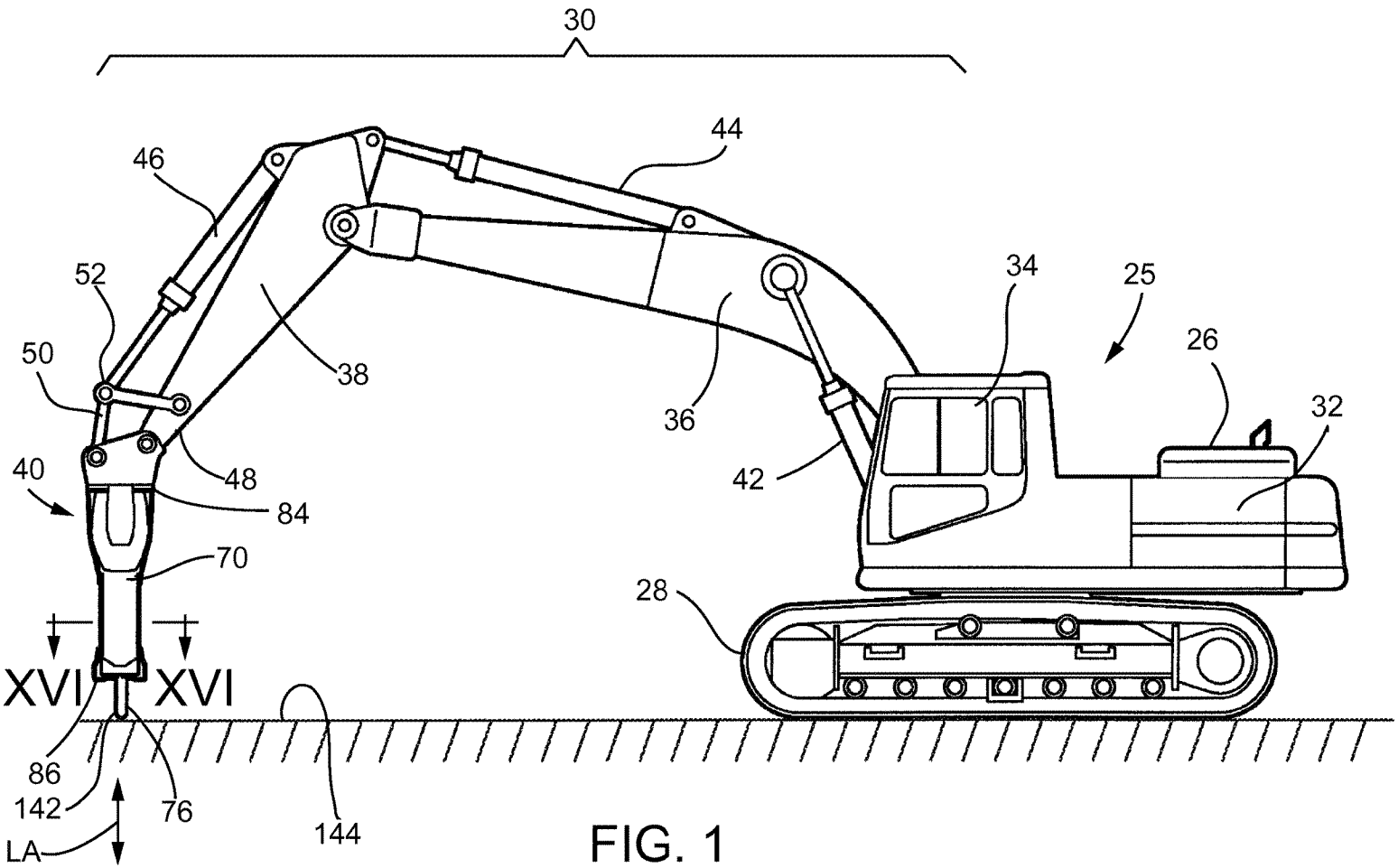
FIG. 1 is a diagrammatic side elevational view of an embodiment of a machine which includes a demolition hammer constructed in accordance with principles of the present disclosure.

Turning now to the Figures, there is shown in FIG. 1 an exemplary embodiment of a machine 25 in the form of an excavator that includes a frame 26 pivotally mounted to a track-type undercarriage 28, and an implement system 30 pivotally mounted to the frame 26. The machine 25 may also be referenced herein as a track-type machine. In other embodiments, the machine 25 can be any suitable mobile or stationary machine for use with a demolition hammer constructed in accordance with principles of the present disclosure, such as, a backhoe, crane, loader, motor grader, or any similar machine, for example.

The frame 26 supports a power system 32, which is configured to supply power to the drive system in the form of the track-type undercarriage in the illustrated embodiment and to the implement system 30, and an operator station 34, which is configured to selectively operate the machine 25, including the track-type undercarriage 28 and the implement system 30. The undercarriage 28 is in operable arrangement with the power system 32 and the operator station 34 to selectively propel the machine 25. In embodiments, the machine 25 can include another suitable drive system, such as another type of track-drive system, a wheel-drive system, or any other type of suitable drive system adapted to propel the machine 25.

The power system 32 can include suitable components, such as, an engine, a cooling system, and/or a hydraulic system, for example, and is located on the frame 26. The power system 32 is adapted to provide operating power for the propulsion of the machine 25 and the operation of the implement system 30 as is understood by those having ordinary skill in the art. In embodiments, the power system 32 can comprise an engine such as, a diesel engine, a gasoline engine, a gaseous fuel-powered engine or any other type of engine. It is contemplated that the power system 32 can embody a non-combustion source of power in other embodiments, such as, a fuel cell, a power storage device, a battery or any other type of power source. The power system 32 can be configured to produce a mechanical or electrical power output that may then be converted to hydraulic power for operating the implement system 58.

The operator station 34 is configured to allow an operator access to controls for operating the machine 25. Further, the operator station 34 is located on the frame 26, which is rotatably coupled with the undercarriage 28 such that the operator station 34 can rotate in a clockwise or a counter-clockwise direction with respect to the undercarriage 28.

The implement system 30 is in operable arrangement with the power system 32 and the operator station 34 such that the implement system 30 is selectively movable by the operator station 34 using power supplied by the power system 32. The implement system 30 includes a boom 36 pivotally coupled to the frame 26, a stick 38 pivotally coupled to the boom 36, and an implement in the form of a demolition hammer 40 pivotally coupled to the stick 38 by a series of pinned joints that permit the various load-bearing members to rotatably move with respect to at least one of the other members. The implement system 30 also includes a boom actuator 42, a stick actuator 44, and an implement actuator 46 that are in operable arrangement with the power system 32 and the operator station 34 to selectively move and articulate the demolition hammer 40. In embodiments, the actuators 42, 44, 46 can comprise hydraulic cylinders that are selectively actuated via a suitable hydraulic system.

The illustrated demolition hammer 40 is pivotally connected to a distal end 48 of the stick 38 and to a hammer linkage assembly 50. The hammer linkage assembly 50 in turn is pivotally connected to the stick 38, the demolition hammer 40, and a distal end 52 of the implement actuator 46. The operator station 34 can be used to operate the implement actuator 46 to pivot the demolition hammer 40 about the pinned joint at the distal end 48 of the stick 38. In use, an operator can control the movement of one or more components of the implement system 30 and/or the track-type undercarriage 28 using the operator station 62 to thereby move the demolition hammer 40 to a location where the demolition hammer 40 can be used to break up material (e.g., dirt, rocks, asphalt, bricks, and/or other materials) (not shown).

While the demolition hammer 40 is illustrated in the context of being mounted to a track-type machine, it should be appreciated that the present disclosure is not thereby limited, and that a wide variety of other machines having a demolition hammer are also contemplated within the present context. For example, in other embodiments, a demolition hammer constructed in accordance with the present disclosure can be included in a stationary arrangement, or in any other application known to those skilled in the art.

Figure 2:
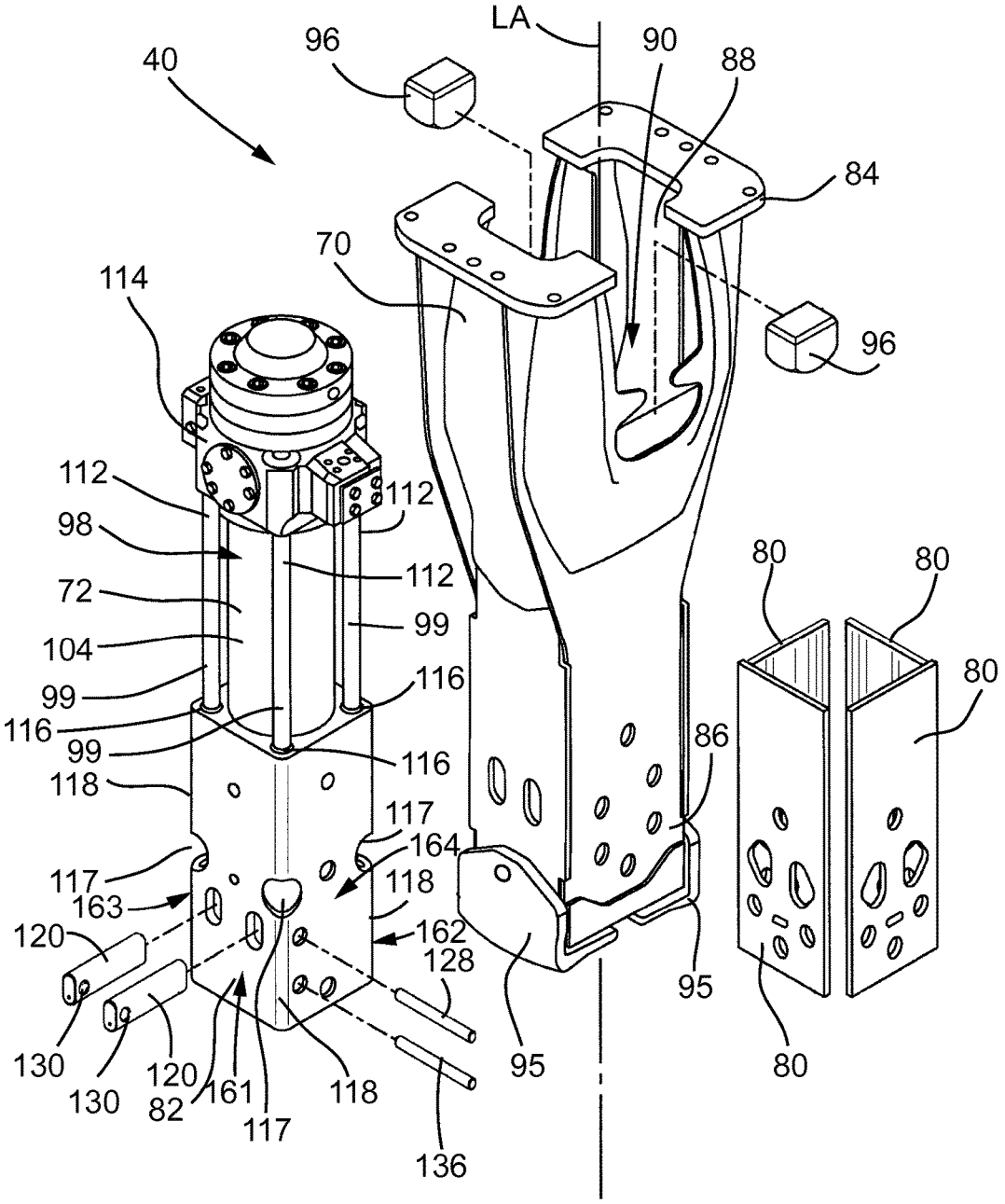
FIG. 2 is a partial, exploded view, in perspective, of a portion of the demolition hammer of FIG. 1.
Figure 3:
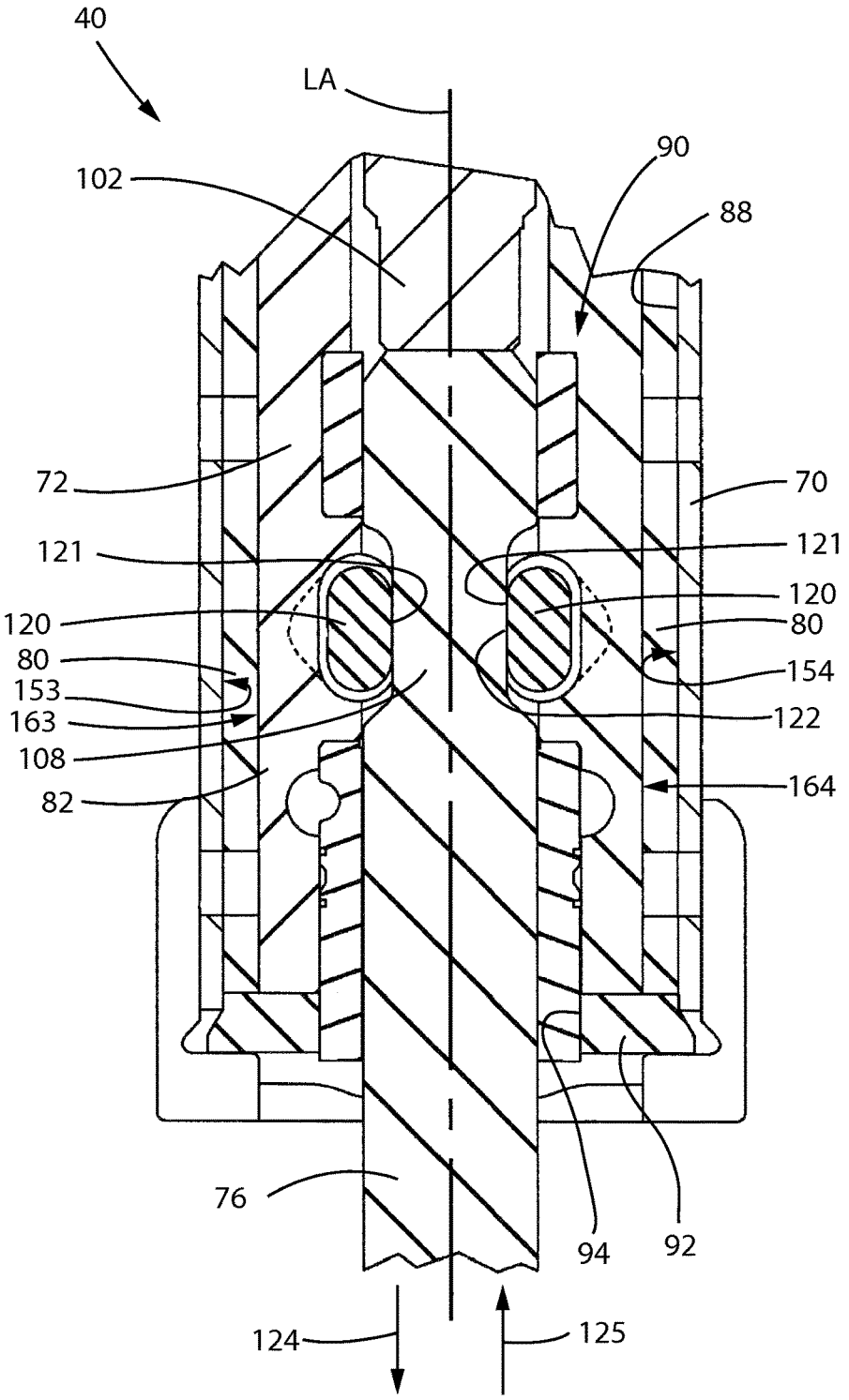
FIG. 3 is a partial longitudinal cross-sectional view of a distal end of the portion of the demolition hammer shown in FIG. 2.
Figure 4:
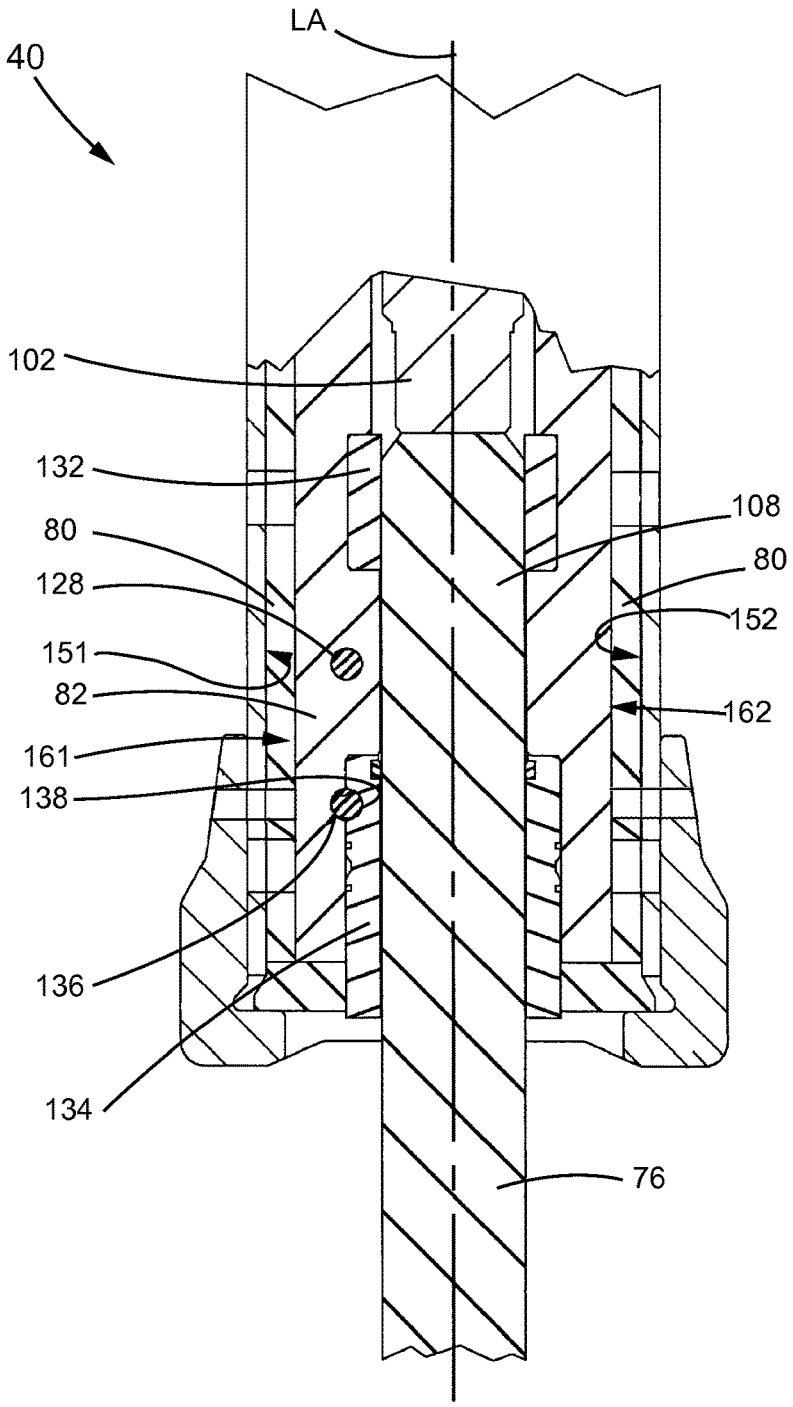
FIG. 4 is a partial longitudinal cross-sectional view of the distal end of the portion of the demolition hammer shown in FIG. 2, as in FIG. 3 but along a plane perpendicular to the plane shown in FIG. 3.

Referring to FIGS. 1-4, the illustrated demolition hammer 40 includes a housing 70, a power cell 72 (see FIG. 2), a hammer bit 76, and a plurality of wear plates 80 (see FIGS. 3 and 4). The power cell 72 is disposed within the housing 70 and is operatively arranged with the hammer bit 76 to reciprocally move the hammer bit 76 along a longitudinal axis LA of the demolition hammer 40. The wear plates 80 are interposed between the housing 70 and the power cell 72 and are configured to help protect a front head 82 (see FIG. 2) of the power cell 72 from wear. It will be apparent to one skilled in the art that various aspects of the disclosed principles relating to wear plates may be used with a variety of demolition hammers. Accordingly, one skilled in the art will understand that, in other embodiments, a demolition hammer following principles of the present disclosure can include different components and can take on different forms.

Referring to FIGS. 1 and 2, the housing 70 includes a proximal end 84 and a distal end 86 in spaced relationship to each other along the longitudinal axis LA. In embodiments, the proximal end 84 can be configured to be attached to the stick 38 and the hammer linkage assembly 50 of the implement system 30. The hammer bit 76 extends from the distal end 86 of the housing 70

Referring to FIGS. 2 and 3, the housing 70 is hollow and has an interior wall surface 88 that defines an interior cavity 90. Referring to FIG. 3, an end plate 92 is attached to the distal end 86 of the housing 70. The end plate 92 defines an opening 94 therethrough that is configured to allow the hammer bit to extend therethrough.

Referring to FIG. 2, a pair of rock claws 95 can be mounted to the distal end 86 of the housing 70. The rock claws 95 provide a surface to engage hard objects, such as, to manipulate hard objects, such as boulders, to better position the objects for breaking by the hammer bit 76, and provide protection to the distal end 86 of the housing 70. The rock claws 95 each includes a side portion that extends up the side of the housing to protect the housing side surface and a bottom portion that extends along the bottom of the housing 70 to protect the bottom portion of the distal end 86 of the housing 70 and the end plate 92. The rock claws 95 are in spaced relationship to each other to permit the hammer bit 76 to extend therebetween.

In embodiments, the rock claws 95 can be configured in a variety of ways. In the illustrated embodiment, the rock claws 95 are separate components that are configured to be attached to opposing sides of the exterior surface of the housing 70 attached, by any suitable means, such as by a fastener. In other embodiments, the rock claws 95 can be attached to the housing by other suitable means, such as, by welding, for example, or can be integrally formed with the distal end 86 of the housing 70.

Referring to FIGS. 2 and 3, the power cell 72 is disposed within the interior cavity 90 of the housing 70. Referring to FIG. 2, the power cell 72 can be supported inside the housing 70 by one or more side buffers 96. The illustrated power cell 72 includes an impact assembly 98 and the front head 82, which are connected together by a plurality of tie rods 99. The impact assembly 98 is configured to reciprocally drive the hammer bit 76. The impact assembly 98 includes a piston 102 (see FIG. 3) adapted to drive the hammer bit 76 and housed within a cylindrical sleeve 104.

The power cell 72 is configured to reciprocally drive the hammer bit 76 along the longitudinal axis LA. The power cell 72 can be configured to utilize a suitable power source, such as a hydraulic and/or pneumatic fluid, for example, to reciprocate the piston 102 against the hammer bit 76 so that the hammer bit 76 reciprocally moves in a repeating, striking manner. For example, a hydraulic or pneumatic circuit (not shown) can be configured to provide pressurized fluid to drive the piston 102 toward the hammer bit 76 during a work stroke and to return the piston 102 during a return stroke. Any suitable hydraulic or pneumatic circuit can be used to provide pressurized fluid to the piston 102, such as the hydraulic arrangement described in U.S. Pat. No. 5,944,120, for example.

The illustrated front head 82 is in the form of a rectangular, four-sided front head 82, which functions as a structural housing to support a proximal end 108 of the hammer bit 76 (see FIG. 3). In embodiments, the front head 82 can comprise a single integral piece or be formed of multiple pieces which are connected together via any suitable technique.

The tie rods 99 are circumferentially disposed about the cylindrical sleeve 104. A proximal end 112 of each of the tie rods 99 is secured to a proximal body 114 of the power cell 72. Each tie rod 99 extends through a respective tie rod passage 116 defined in the front head 82. A distal end of each of the tie rods 99 can be threadedly retained by a tie rod nut (not shown) which can be placed in a respective tie rod nut pocket 117 defined in the exterior of the front head 82 and in communication with a respective tie rod passage 116. In embodiments, each tie rod nut pocket 117 can be correspondingly positioned within one corner 118 of the front head 82 to accommodate one tie rod nut (not shown).

Referring to FIGS. 2 and 3, a pair of bit retaining members 120 is provided to movably mount the hammer bit 76 to the power cell 72. Referring to FIG. 3, the bit retaining members 120 are in engaging contact with a pair of opposing flat surfaces 121 of a necked portion 122 of the proximal end 108 of the hammer bit 76 in such a way as to allow the hammer bit 76 to move along the longitudinal axis LA with respect to the front end 82 over a range of travel in both an extending direction 124 and a retracting direction 125 along the longitudinal axis LA. The interaction between the bit retaining members 120 and the necked portion 122 define the limits of the reciprocal range of travel of the hammer bit 76. The bit retaining members 120 may also absorb some of the impact load if the hammer bit 76 does not contact a hard object or ground surface during a power stroke. In the depicted embodiment, the bit retaining members 120 have an oval cross-section with a height greater than a width, but in other embodiments, the bit retaining members 120 can have a different configuration. Though described as a pair, the bit retaining members 120 can be configured differently from one another in other embodiments.

Referring to FIGS. 2 and 4, the bit retaining members 120 are held in place by a bit cross pin 128. The bit cross pin 128 is received through an aperture 130 in each of the bit retaining members 120. In the depicted embodiment, the bit cross pin 128 has a circular cross-section, but, in other embodiments, the bit cross pin 128 can have a different configuration.

Referring to FIG. 4, a proximal bushing 132 and a distal bushing 134 are mounted to the front head 82 with the hammer bit 76 extending therethrough. The proximal bushing 132 and the distal bushing 134 are configured to guide the hammer bit 76 during operation of the demolition hammer 40. The distal bushing 134 can be mounted to the front end 82 via a bushing retaining pin 136 (see FIG. 2, also) which can be disposed within a mating groove 138 defined in the exterior of the distal bushing 134 to hold the distal bushing 134 in place. In the depicted embodiment, the bushing retaining pin 136 has a circular cross-section that corresponds to the shape of the groove 138, but in other embodiments, the bushing retaining pin 136 and the mating groove 138 of the distal bushing 134 can have different configurations.

Referring to FIG. 4, the piston 102 is operatively disposed to reciprocate along the longitudinal axis LA to drive the hammer bit 76. The proximal end 108 of the hammer bit 76 is positioned within the front head 82 to be struck by the piston 102. The hammer bit 76 extends from the front head 82 such that a distal end 142 of the hammer bit 76 (see FIG. 1) is positioned outside of the front end 82 to allow it to be placed into impacting contact with the surface 144 or objects positioned thereon. Particularly, the hammer bit 76 can be slidably retained within the proximal bushing 132 and the distal bushing 134, both of which are fixably held within the front head 82.

The demolition hammer 40 can be adapted to produce cyclic movement of the hammer bit 76 at an intensity sufficient to demolish rocks and dense minerals, by way of example. The functional parts of the demolition hammer 40, including hammer bit 76 may be constructed of a forged or otherwise hardened metal such as a refined steel, for example, to assure appropriate strength, although other suitable materials such as diamond bits for operative portions of the hammer bit 76, for example, can be utilized within the scope of this disclosure. In embodiments, any suitable hammer bit 76 can be used. For example, in embodiments, the hammer bit 76 can include a distal end having different configurations (blades, points, scoops, etc.).

Referring to FIG. 2, when the demolition hammer 40 is assembled, the power cell 72 is supported inside the housing 70 such that some relative movement may occur between the power cell 72 and the housing 70 during operation. The wear plates 80 are configured for being interposed between the housing 70 and the power cell 72 to prevent the power cell 72 from rubbing against the inside of the housing 70. Each wear plate 80 is interposed between the interior wall surface 88 of the housing 70 and the front head 82 of the power cell 72.

Referring to FIGS. 2-4, the interior wall surface 88 of the housing 70 includes four wall segments 151, 152, 153, 154 such that the interior cavity 90 is generally rectangular. The front head 82 of the power cell 72 includes four sides 161, 162, 163, 164 which give the front head 82 a rectangular shape. When the power cell 72 is installed in the housing 70, the four sides 161, 162, 163, 164 of the front head 82 of the power cell 72 are in respective, corresponding relationship with the four wall segments 151, 152, 153, 154 of the housing 70. The wear plates 80 are respectively positioned between four sides 161, 162, 163, 164 of the front head 82 of the power cell 72 and the four wall segments 151, 152, 153, 154 of the housing 70. In embodiments, one of the wear plates 80 is respectively positioned between the power cell 72 and each of the wall segments 151, 152, 153, 154 of the housing 70.

In the illustrated embodiment, the wear plates 80 circumscribe the front head 82 of the power cell 72. In other embodiments, more or less than four wear plates 80 can be used. The wear plates 80 are configured to be interchangeable with one another. The wear plates 80 are substantially identical to each other. Accordingly, it will be understood that the description of one wear plate 80 is applicable to each of the other wear plates 80, as well.

Figure 6:
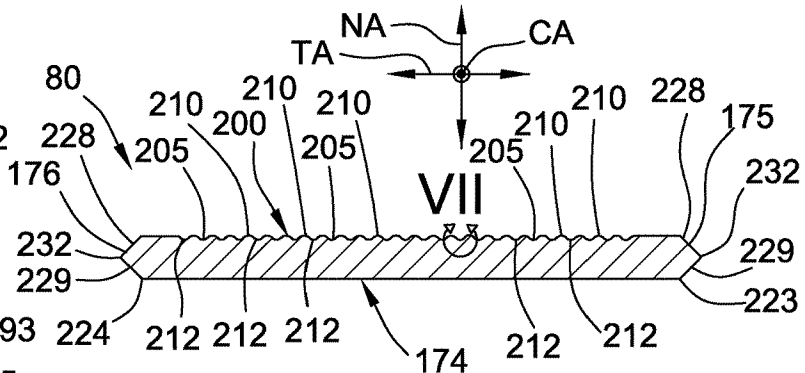
FIG. 6 is a cross-sectional view of the wear plate of FIG. 5 taken along line VI-VI in FIG. 5.
Figure 7:
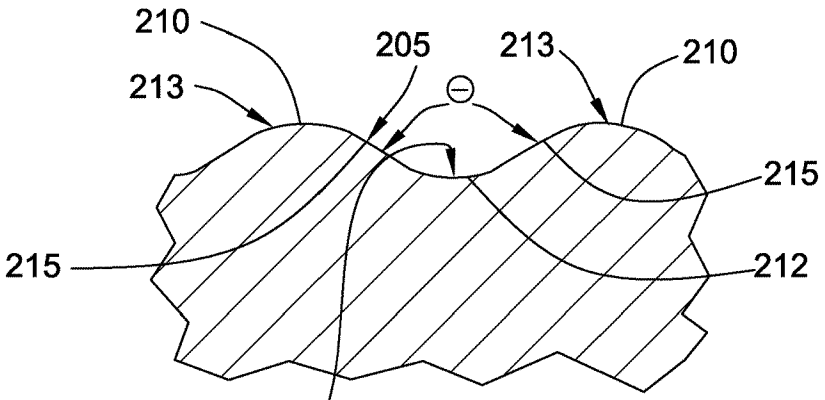
FIG. 7 is an enlarged, detail view taken from FIG. 6, as indicated by circle VII in FIG. 6.
Figure 5:
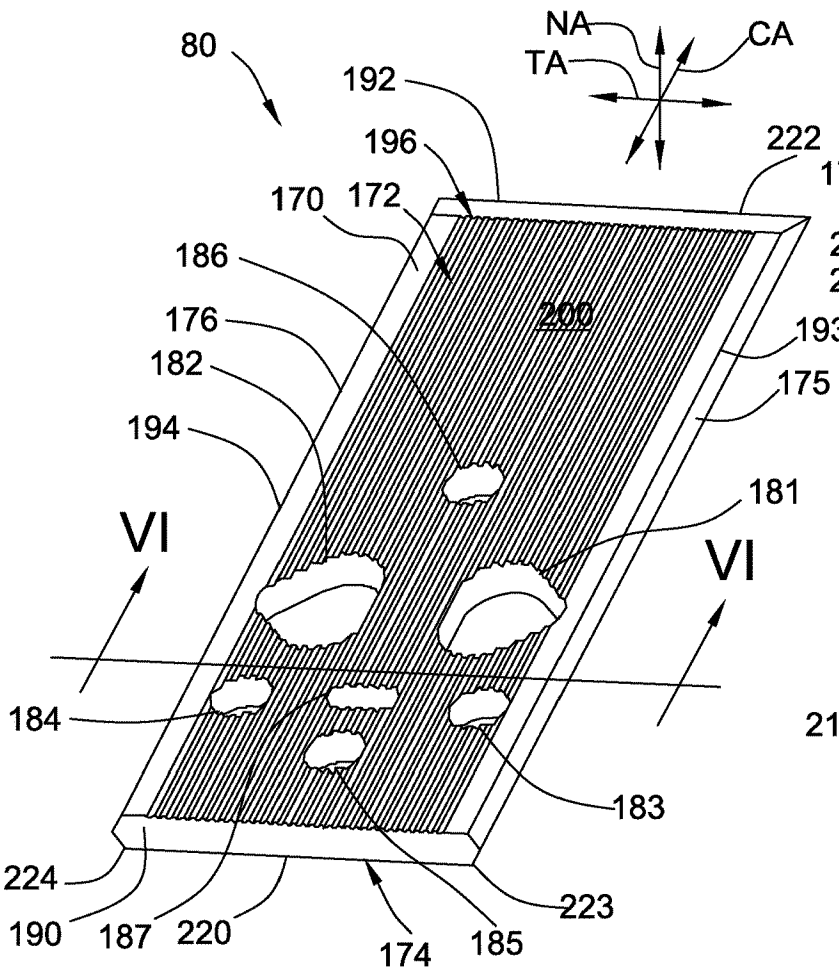
FIG. 5 is a perspective view of an embodiment of a wear plate constructed in accordance with principles of the present disclosure, which is suitable for use in embodiments of a demolition hammer following principles of the present disclosure.

Referring to FIGS. 5-7, one of the wear plates 80 of the demolition hammer 40 is shown. The wear plate 80 is configured to be interposed between the housing 70 and the power cell 72. The wear plate 80 comprises a body 170 defining a central longitudinal axis CA. The body 170 includes a first face 172, a second face 174, and a pair of sidewalls 175, 176.

Referring to FIG. 5, in embodiments, the body 170 of the wear plate 80 can define a set of universal openings that allow the wear plate 80 to be used in at least two different locations about the perimeter of the front head 82 of the power cell 72. For example, the illustrated wear plates 80 each includes a set of openings 181, 182, 183, 184, 185, 186, 187 which are configured to provide passages therethrough which are aligned with corresponding openings about the wall segments 151, 152, 153, 154 of the housing 70 and the sides 161, 162, 163, 164 of the power cell 72 (such as those used for the bit retaining members 120, the bit cross pin 128, and the bushing retaining pin 136, for example). Thus, each wear plate 80 can be used in different positions interposed between different respective mating wall segments 151, 152, 153, 154 and sides 161, 162, 163, 164 and still have appropriate openings for the particular position.

In embodiments, the body 170 defines at least two openings 181, 182 that extend between the first face 172 and the second face 174 and that are symmetrically positioned about the central longitudinal axis CA. In the illustrated embodiment, the set of openings 181, 182, 183, 184, 185, 186, 187 is symmetrically positioned with respect to the central longitudinal axis CA.

In embodiments, the openings 181, 182 for the bit retaining members 120 can be shaped in a variety of ways. The openings 181, 182 are each configured to be able to receive therethrough both the bit retaining member 120 and the bit cross pin 128, non-concurrently. In the illustrated embodiment, the openings 181, 182 are positioned substantially equidistant and on opposite sides of the central longitudinal axis CA such that they are symmetrical about the central longitudinal axis CA with respect to each other.

In the illustrated embodiment, the openings 183, 184 for the bushing retaining pin 136 is positioned substantially equidistant and on opposite sides of the central longitudinal axis CA such that they are symmetrical about the central longitudinal axis CA with respect to each other. In other embodiments, the wear plate 80 may have more than two opening configured to receive a given retaining member or pin.

The openings 185, 186 symmetrically disposed along the central longitudinal axis CA can be used as grease port apertures configured to provide access to grease conduits that supply lubricant to the distal bushing 134 and the proximal bushing 132, respectively. The other opening 187 symmetrically disposed along the central longitudinal axis CA can be used to help secure one of the rock claws 95 to the housing. The symmetrical layout of set of openings 181, 182, 183, 184, 185, 186, 187 with respect to the central longitudinal axis CA renders the wear plate reversible.

Referring to FIG. 5, the first face 172 is generally rectangular. The first face 172 includes a first face bottom end 190, a first face top end 192 in spaced relationship to the first face bottom end 190 along the central longitudinal axis CA, and a pair of first face lateral edges 193, 194 in spaced relationship to each other along a transverse axis TA that is perpendicular to the central longitudinal axis CA. The first face lateral edges 193, 194 extend along the central longitudinal axis CA between the first face bottom end 190 and the first face top end 192. The first face bottom end 190 and the first face top end 192 extend along the transverse axis TA. In embodiments, the first face top end 192 comprises a chamfer surface 196.

Referring to FIGS. 5-7, the first face 172 includes a first interface surface 200. The first interface surface 200 is configured to be placed in proximate relationship with the front head 82 of the power cell 72. In embodiments, the first interface surface 200 defines at least one first face channel 205 extending along the central longitudinal axis CA. Each first face channel 205 can be configured to provide a debris channel that permits debris accumulated between the wear plate 80 and the front head 82 of the power cell 72 to settle in the first face channel 205 such that the abrasive effect of the trapped debris upon the front head 82 of the power cell 72 is diminished.

In the illustrated embodiment, the first interface surface 200 comprises a striated surface defining a series of first face channels 205 disposed in spaced relationship to each other along the transverse axis TA and extending along the central longitudinal axis CA. In embodiments, the series of first channels 205 extends along the transverse axis for a predetermined distance. In embodiments, the series of first face channels 205 extends from the first face bottom end 190 along the central longitudinal axis CA for a predetermined distance.

Referring to FIG. 5, the illustrated series of first face channels 205 extends along the central longitudinal axis substantially completely from the first face bottom end 190 to the first face top end 192. Referring to FIG. 6, the illustrated striated surface 200 extends substantially completely along the transverse axis TA between the first face lateral edges 193, 194. In other embodiments, the striated surface 200 can cover different amounts and different regions of the first face 172.

Referring to FIGS. 6 and 7, the striated surface 200 includes a series of convex segments 210 extending along the central longitudinal axis CA and a series of concave segments 212 extending along the central longitudinal axis CA and disposed in alternating relationship with the series of convex segments 210. The series of first face channels 205 corresponds to the series of concave segments 212. The series of convex segments 210 are configured to be positioned in proximate relationship to the front head 82 and define a contact interface surface portion of the striated surface 200.

The illustrated series of convex segments 210 each includes a curved convex surface 213. The illustrated series of concave segments 212 each includes a curved concave surface 214. In the illustrated embodiments, the radius of curvature of each curved convex surface 213 and each curved concave surface 214 is substantially identical to impart the striated surface 200 with a generally sinusoidal transverse cross-sectional shape.

In other embodiments, the radius of curvature of each curved convex surface 213 can differ from that of each curved concave surface 214. In still other embodiments, the series of convex segments 210 can include at least one convex segment that differs from at least one other convex segment of the series of convex segments 210. Similarly, in other embodiments, the series of concave segments 212 can include at least one concave segment that differs from at least one other concave segment of the series of concave segments 212. In other embodiments, the series of convex segments 210 and the series of concave segments 212 can impart the striated surface 200 with a different transverse cross-sectional shape, such as a saw-tooth pattern or a rectangular waveform, for example.

In the illustrated embodiment, each adjoining convex segment 210 and concave segment 212 meet at an inclined surface 215 that cooperates with an opposing inclined surface 215 on the other side of the particular concave segment 212 to define a debris channel angle θ therebetween. In embodiments, the debris channel angle θ can be in a range between one hundred five degrees and one hundred thirty-five degrees. The illustrated debris channel angle θ is about one hundred fifteen degrees. In embodiments, the debris channel angle θ can be configured to facilitate the collection of debris in the first face channels 205 away from the contact interface surface between the front head 82 and the wear plate 80 defined by the series of convex segments 210.

Referring to FIGS. 5 and 7, the second face 174 is substantially planar and is generally parallel to the first face 172. The first face 172 and the second face 174 are in spaced relationship to each other along a normal axis NA that is mutually perpendicular to the central longitudinal axis CA and the transverse axis TA. The second face 174 is substantially the same shape and size as the first face 172 is aligned therewith along the central longitudinal axis CA and the transverse axis TA. The second face 174 includes a second face bottom end 220, a second face top end 222 in spaced relationship to the second face bottom end 220 along the central longitudinal axis CA, and a pair of second face lateral edges 223, 224 in spaced relationship to each other along the transverse axis TA.

The pair of sidewalls 175, 176 respectively extends between the pair of first face lateral edges 193, 194 of the first face 172 and the pair of second face lateral edges 223, 224 of the second face 174. In embodiments, the pair of sidewalls 175, 176 is symmetrically configured about the central longitudinal axis CA with respect to each other. In the illustrated embodiment, the sidewalls 175, 176 each include a pair of miter surfaces 228, 229. The miter surfaces 228, 229 of each of the pair of sidewalls 175, 176 respectively converge from the first face 172 and the second face 174 together to a lateral apex 232.

Figure 16:
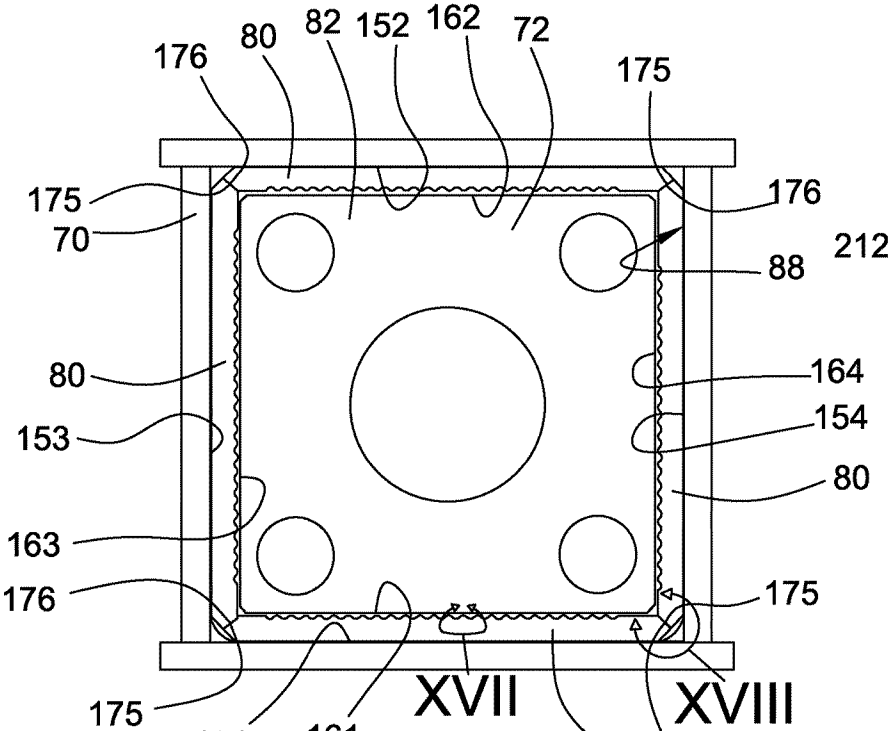
FIG. 16 is an enlarged, cross-sectional view of the demolition hammer of FIG. 1 taken along line XVI-XVI in FIG. 1.

The miter surfaces 228 of the angled sidewalls 175, 176 adjacent the first face 172 are configured to engage the corresponding miter surface 228 of the other wear plates 80 to form a rectangular wear plate structure (as shown in FIG. 16). In embodiments, the miter surfaces 228, 229 of each sidewall 175, 176 are substantially congruent such that the wear plate 80 is reversible and the miter surfaces 229 of the angled sidewalls 175, 176 adjacent the second face 174 can be placed in engaging relationship with either of the miter surfaces 228, 229 of the other wear plates to form a similar rectangular wear plate structure.

The wear plate 80 can be made from any suitable material. In embodiments, the wear plate 80 is made from a material that is softer than the material from which the front head 82 of the power cell 72 is made. In embodiments, the wear plate 80 is made from a material having a durometer hardness in a range between 40 and 55 Shore D. In embodiments, the wear plate is made from a suitable urethane.

The wear plate 80 can be configured in a variety of ways. It will be understood that in other embodiments, the wear plate 80 can have a different configuration and can be constructed in other ways for interposition between the power cell 72 and the housing 70 used.

Referring to FIGS. 8-11, another embodiment of a wear plate 280 constructed in accordance with principles of the present disclosure is shown. The wear plate 280 is configured to be interposed between the housing 70 and the power cell 72. The wear plate 280 comprises a body 370 defining a central longitudinal axis CA. The body 370 includes a first face 372, a second face 374 in opposing relationship to the first face 372, and a pair of sidewalls 375, 376 extending between the first face 372 and the second face 374.

Figure 9:
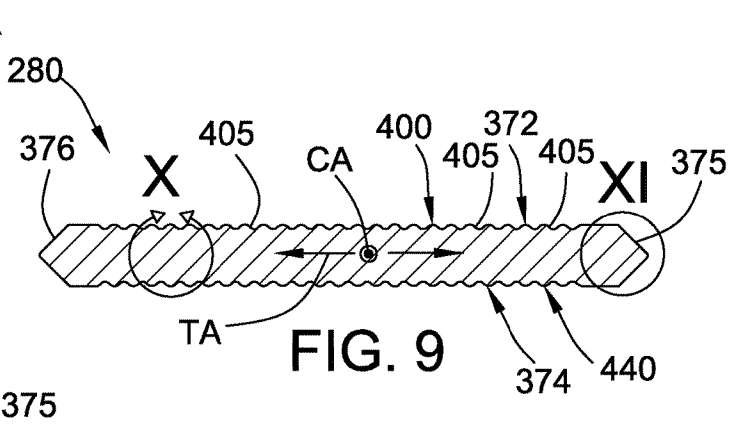
FIG. 9 is a cross-sectional view of the wear plate of FIG. 8 taken along line IX-IX in FIG. 8.
Figure 10:
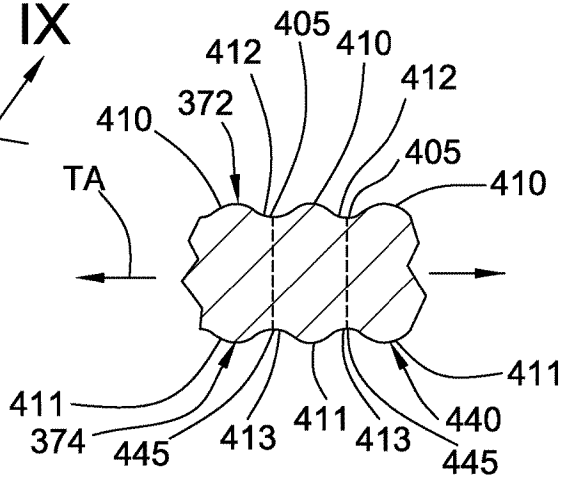
FIG. 10 is an enlarged, detail view taken from FIG. 9, as indicated by circle X in FIG. 9.
Figure 8:
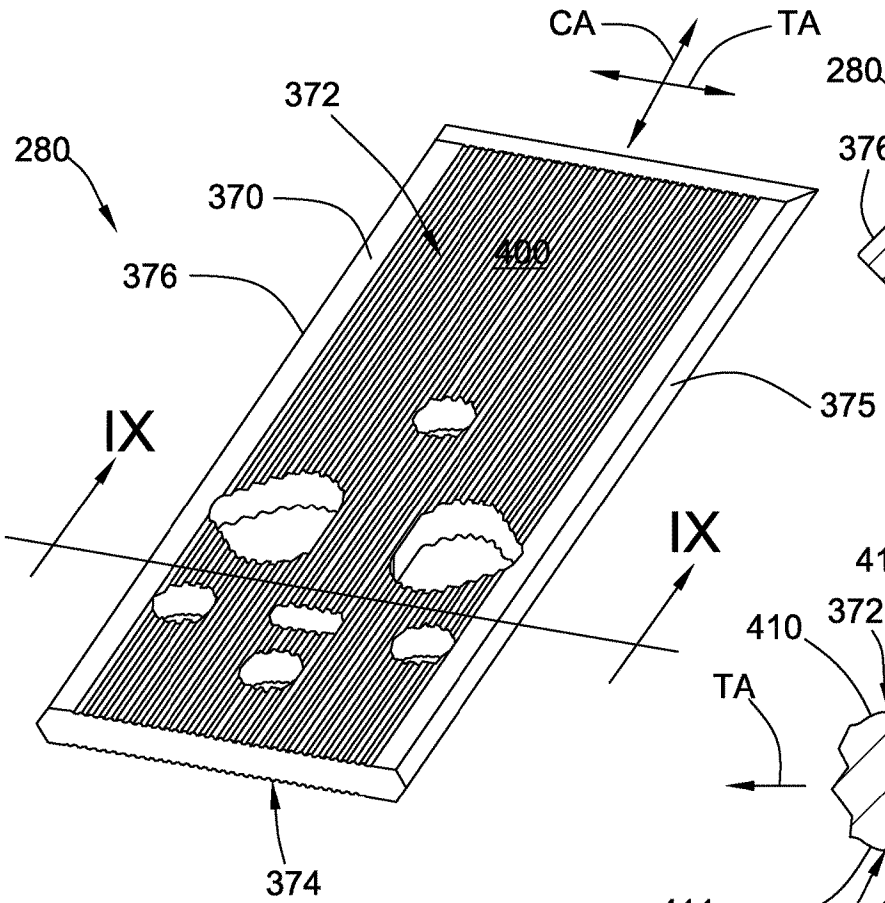
FIG. 8 is a perspective view of another embodiment of a wear plate constructed in accordance with principles of the present disclosure, which is suitable for use in embodiments of a demolition hammer following principles of the present disclosure.

Referring to FIGS. 8-10, the first face 372 includes a first interface surface 400. The first interface surface 400 is configured to be placed in proximate relationship with the front head 82 of the power cell 72. In embodiments, the first interface surface 400 defines at least one first face channel 405 extending along the central longitudinal axis CA. Each first face channel 405 can be configured to provide a debris channel that permits debris accumulated between the first face 372 of the wear plate 280 and the front head 82 of the power cell 72 to settle in the first face channel 405 such that the abrasive effect of the trapped debris upon the front head 82 of the power cell 72 is diminished. In the illustrated embodiment, the first interface surface 400 comprises a striated surface defining a series of first face channels 405 disposed in spaced relationship to each other along the transverse axis TA and extending along the central longitudinal axis CA.

The second face 374 includes a second interface surface 440. The second interface surface 440 is substantially identical to the first interface surface 400. In embodiments, the second interface surface 440 defines at least one second face channel 445 extending along the central longitudinal axis CA. In the illustrated embodiment, the second interface surface 440 comprises a striated surface defining a series of second face channels 445 disposed in spaced relationship to each other along the transverse axis TA and extending along the central longitudinal axis CA. Referring to FIG. 10, the series of first face channels 405 is respectively aligned with the series of second face channels 445 along the transverse axis TA.

Referring to FIGS. 9 and 10, the striated surfaces 400, 440 of the first face 372 and the second face 374, respectively, each includes a series of convex segments 410, 411 extending along the central longitudinal axis CA and a series of concave segments 412, 413 extending along the central longitudinal axis CA and disposed in alternating relationship with the series of convex segments 412, 413, respectively. The series of first face channels 405 and the series of second face channels 445 correspond to the series of concave segments 412, 413 on the first face 372 and the second face 374, respectively. The series of convex segments 410, 411 are configured to be positioned in proximate relationship to the front head 82 and define a contact interface surface portion of the striated surface 400, 440 of the first face 372 and the second face 374, respectively.

Figure 11:
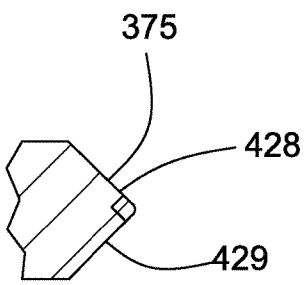
FIG. 11 is an enlarged, detail view taken from FIG. 9, as indicated by circle XI in FIG. 9.

The pair of sidewalls 375, 376 is symmetrically configured about the central longitudinal axis CA with respect to each other such that the wear plate 280 is reversible. Either the first face 372 or the second face 374 can be placed in proximate relationship with the front head 82 of the power cell when the wear plate 280 is interposed between the housing 70 and the power cell 72. Each of the pair of sidewalls 375, 376 includes a pair of miter surfaces 428, 429 respectively converging from the first face 372 and the second face 374 to a lateral apex 432. Referring to FIG. 11, each of the pair of miter surfaces 428, 429 is in perpendicular relationship with respect to each other. The wear plate 280 of FIG. 8 can be similar in other respects to the wear plate 80 of FIG. 5.

Referring to FIGS. 12-15, another embodiment of a wear plate 480 constructed in accordance with principles of the present disclosure is shown. The wear plate 480 is configured to be interposed between the housing 70 and the power cell 72. The wear plate 480 comprises a body 570 defining a central longitudinal axis CA. The body 570 includes a first face 572, a second face 574 in opposing relationship to the first face 572, and a pair of sidewalls 575, 576 extending between the first face 572 and the second face 574.

The wear plate 480 of FIGS. 12-15 is the same as the wear plate 280 of FIGS. 8-11 except that the first interface surface 600 of the first face 572 is in offset relationship with the second interface surface 640 of the second face 574. The offset relationship of the first interface surface 600 and the second interface surface 640 impart the wear plate 480 with more flexibility than the wear plate 280 of FIG. 8.

Figure 13:
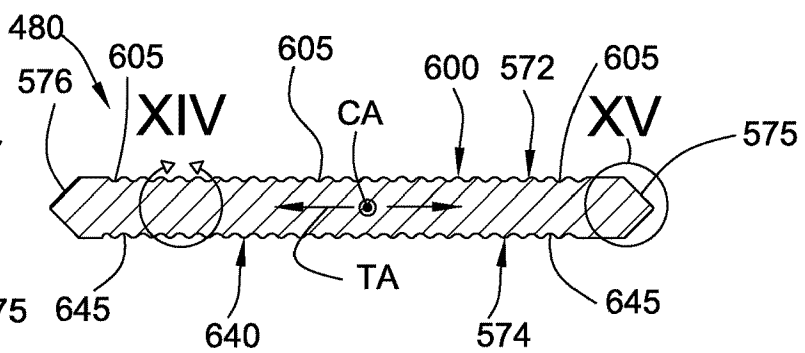
FIG. 13 is a cross-sectional view of the wear plate of FIG. 12 taken along line XIII-XIII in FIG. 12.
Figure 15:
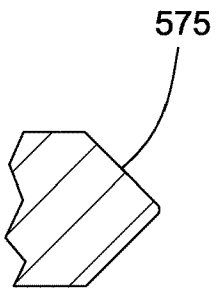
FIG. 15 is an enlarged, detail view taken from FIG. 13, as indicated by circle XV in FIG. 13.
Figure 14:
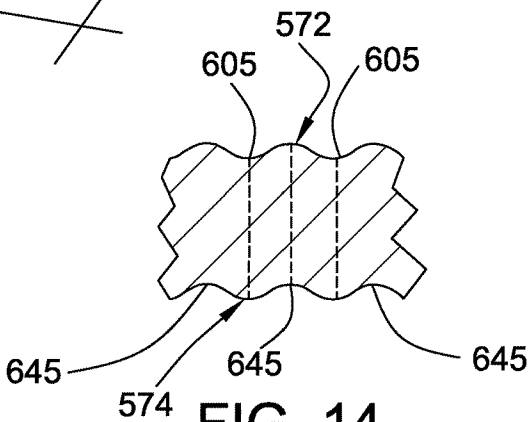
FIG. 14 is an enlarged, detail view taken from FIG. 13, as indicated by circle XIV in FIG. 13.

The first interface surface 600 comprises a first striated surface defining a series of first face channels 605 disposed in spaced relationship to each other along the transverse axis TA and extending along the central longitudinal axis CA. The second interface surface 640 comprises a second striated surface defining a series of second face channels 645 disposed in spaced relationship to each other along the transverse axis TA and extending along the central longitudinal axis CA. Referring to FIG. 14, the series of first face channels 605 is disposed in respective offset relationship with the series of second face channels 645 along the transverse axis TA. Referring to FIGS. 13 and 15, the sidewalls 575, 576 of the wear plate 480 are symmetrical about the central longitudinal axis CA such that the wear plate 480 is reversible. The wear plate 480 of FIG. 12 can be similar in other respects to the wear plate 80 of FIG. 5 and the wear plate 280 of FIG. 8.

Figure 17:
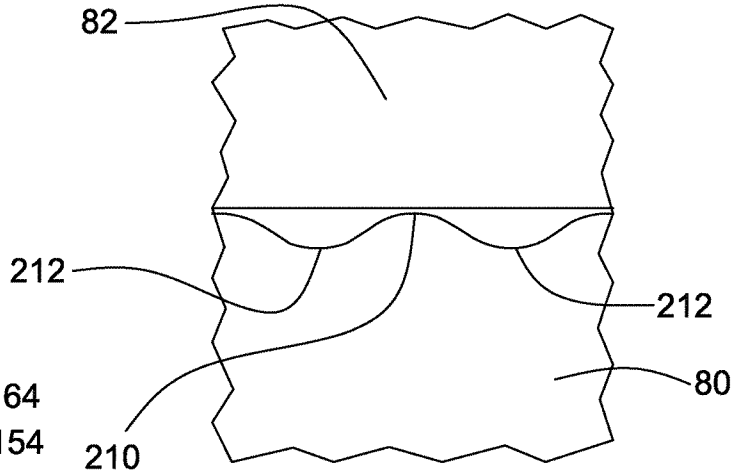
FIG. 17 is an enlarged, detail view taken from FIG. 16, as indicated by circle XVII in FIG. 16.
Figure 18:
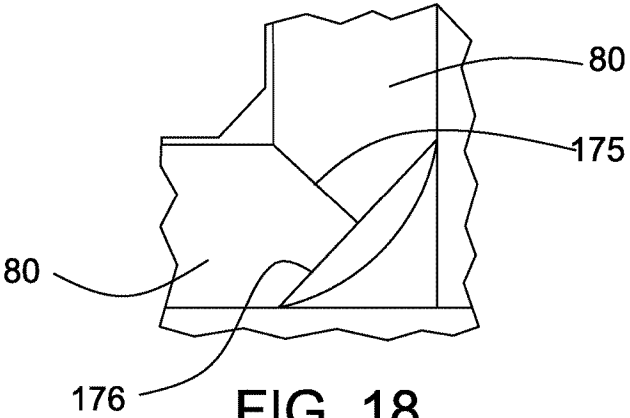
FIG. 18 is an enlarged, detail view taken from FIG. 16, as indicated by circle XVIII in FIG. 16.

Referring to FIGS. 16-18, the interior wall surface 88 of the housing 70 includes four wall segments 151, 152, 153, 154 defining a rectangular interior cavity. The front head 82 of the power cell 72 includes four side 161, 162, 163, 164 having a rectangular shape. The four sides 161, 162, 163, 164 of the front head 82 of the power cell 72 are in respective, corresponding relationship with the four wall segments 151, 152, 153, 154 of the housing 70. The four wear plates 80 circumscribe the front head 82 of the power cell 72. Each wear plate 80 is interposed between the four wall segments 151, 152, 153, 154 of the interior wall surface 88 of the housing 70 and the four sides 161, 162, 163, 164 of the front head 82 of the power cell 72, respectively.

Referring to FIG. 17, the concave segments 210 of the first interface surface 200 of the wear plate 80 are in proximate, contacting relationship with the front head 82 of the power cell 72. The concave segments 212 of the first interface surface 200 correspond with the first face channels 205 of the wear plate 80 and are in relative, spaced relationship with the front head 82. The series of first face channels 205 are configured to accommodate debris trapped between the wear plate 80 and the front head 82 to reduce the abrasive effect of such debris upon the front head 82.

Figure 12:
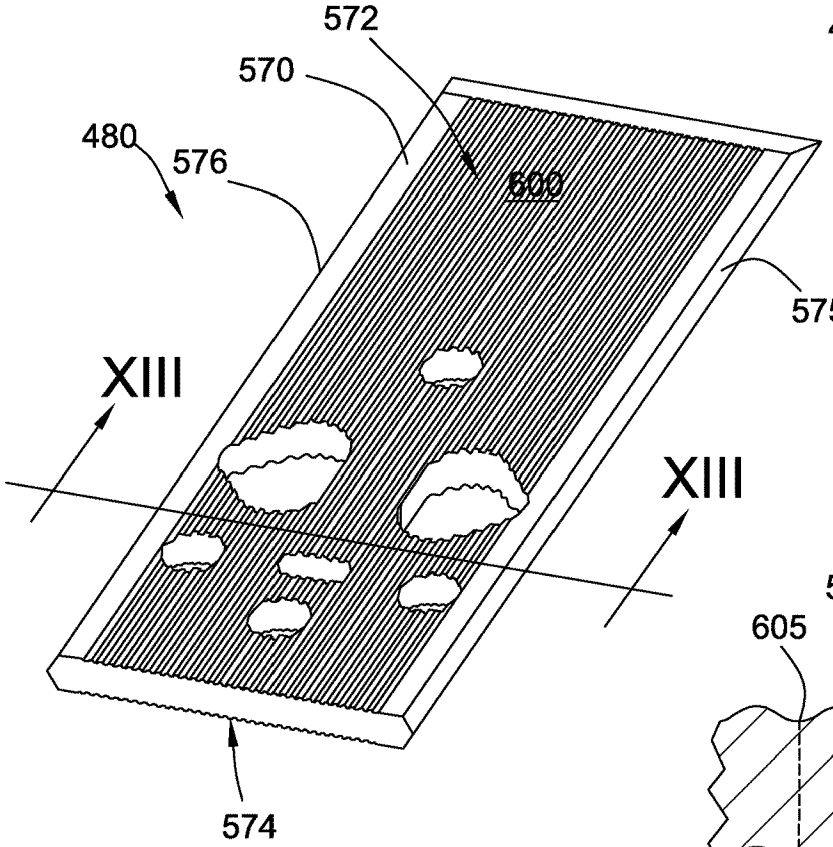
FIG. 12 is a perspective view of another embodiment of a wear plate constructed in accordance with principles of the present disclosure, which is suitable for use in embodiments of a demolition hammer following principles of the present disclosure.

Referring to FIGS. 16 and 18, each of the four wear plates 80 includes a pair of mitered sidewalls 175, 176 configured to contactingly engage a respective pair of adjacent mitered sidewalls 176, 175 of the adjoining wear plates 80. In embodiments, the mitered sidewalls 175, 176 are symmetrically configured so that the four wear plates 80 are reversible, such as is shown in FIGS. 8 and 12, for example. In embodiments, different types of wear plates can be used together, such as one or more of the wear plates 280, 480 of FIGS. 8 and 12, respectively, with the wear plate 80 of FIG. 5 or one or more other types of wear plates.

Figure 19:
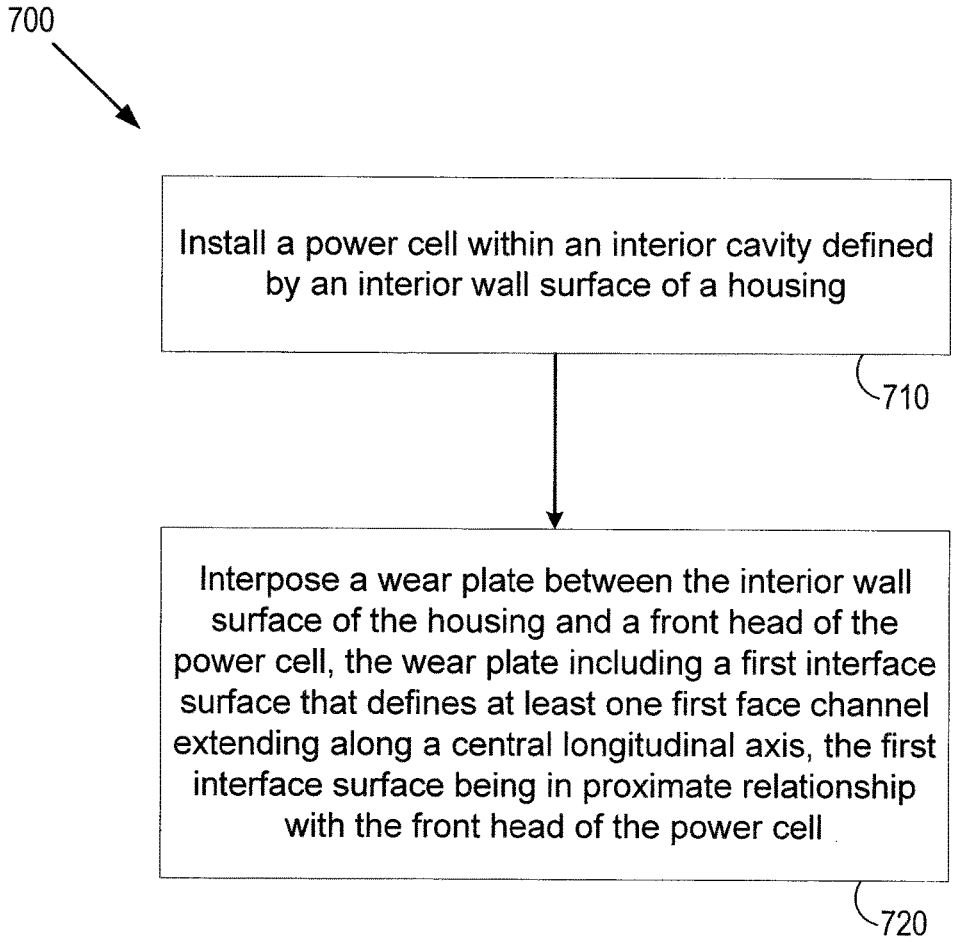
FIG. 19 is a flowchart illustrating steps of an embodiment of a method for sealing a track joint following principles of the present disclosure.

Referring to FIG. 19, steps of an embodiment of a method of assembling 700 a demolition hammer following principles of the present disclosure are shown. The method of assembling 700 includes installing a power cell within an interior cavity defined by an interior wall surface of a housing (step 710). A wear plate is interposed between the interior wall surface of the housing and a front head of the power cell (step 720). The wear plate includes a body defining a central longitudinal axis. The body has a first face. The first face includes a first face bottom end, a first face top end in spaced relationship to the first face bottom end along the central longitudinal axis, and a pair of first face lateral edges in spaced relationship to each other along a transverse axis that is perpendicular to the central longitudinal axis. The first face includes a first interface surface. The first interface surface defines at least one first face channel extending along the central longitudinal axis. The first interface surface is in proximate relationship with the front head of the power cell.

In embodiments, the wear plate includes a second face which is in spaced relationship to the first face along a normal axis that is mutually perpendicular to the central longitudinal axis and the transverse axis. The second face of the wear plate includes a second interface surface. The second interface surface defines at least one second face channel extending along the central longitudinal axis. In embodiments, the method of assembling 700 further includes removing the wear plate from between the interior wall surface of the housing and the front head of the power cell. The wear plate is re-installed between the interior wall surface of the housing and the front head of the power cell in a reversed orientation such that the second interface surface is in proximate relationship with the front head of the power cell.

INDUSTRIAL APPLICABILITY

The industrial applicability of the embodiments of a demolition hammer and a wear plate system described herein will be readily appreciated from the foregoing discussion. At least one embodiment of the disclosed wear plates may be used for a demolition hammer. At least one embodiment of the demolition hammer can be used in a machine for typical applications, such as those found in breaking rock in quarries, trenching or other soil excavating activities in construction, demolishing concrete, breaking up asphalt in road construction, etc.

A wear plate constructed according to principles of the present disclosure can help reduce the abrasive effect of debris trapped between the wear plate and the front head of the power cell. The dirt can be accumulated in the series of debris channels defined by the interface surface in proximate relationship with the front head to keep the debris away from the contact surface between front head and wear plate and thereby reduce the wear of the outside surface of the front head and prolong the life of the front head. Furthermore, the front head can be reused for rebuilding the demolition hammer during a remanufacturing stage of the demolition hammer.

During operation of the demolition hammer, movement of the power cell relative to the housing may result in wear of the wear plates. Thus, the wear plates may need periodic replacement. The disclosed interchangeable and reversible wear plates (e.g. the side wear plates may be switched with the front and back wear plates and/or the second face may be positioned in proximate relationship with the front head) to extend the life of a set of wear plates.

Although the disclosed embodiments have been described with reference to a demolition hammer in which the tool is driven by a hydraulically or pneumatically actuated piston, the disclosed embodiments are applicable to any tool assembly having a reciprocating work tool movable within a chamber by a suitable drive structure and/or return structure.

Embodiments of a demolition hammer and a wear plate according to principles of the present disclosure may find potential application in any suitable machine. Such machines may include, but are not limited to, mobile or stationary machines used for construction, mining, farming, forestry, transportation, and other similar industries. In some embodiments, the machine can be an excavator, backhoe, dozer, load, motor grader, or any suitable off-highway vehicle.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for the features of interest, but not to exclude such from the scope of the disclosure entirely unless otherwise specifically indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

What is claimed is:

1. A wear plate for a demolition hammer having a housing and a power cell, the wear plate for being interposed between the housing and the power cell, the wear plate comprising a body defining a central longitudinal axis and including:

a first face, the first face including a first face bottom end, a first face top end in spaced relationship to the first face bottom end along the central longitudinal axis, and a pair of first face lateral edges in spaced relationship to each other along a transverse axis that is perpendicular to the central longitudinal axis;

a second face, the second face including a second face bottom end, a second face top end in spaced relationship to the second face bottom end along the central longitudinal axis, and a pair of second face lateral edges in spaced relationship to each other along the transverse axis, the first face and the second face being in spaced relationship to each other along a normal axis that is mutually perpendicular to the central longitudinal axis and the transverse axis; and a pair of sidewalls, the pair of sidewalls respectively extending between the pair of first face lateral edges of the first face and the pair of second face lateral edges of the second face;

wherein the first face includes a first interface surface, the first interface surface comprising a striated surface defining a series of first face channels disposed in spaced relationship to each other along the transverse axis and extending along the central longitudinal axis;

wherein the second face includes a second interface surface, the second interface surface defining at least one second face channel extending along the central longitudinal axis; and wherein each of the pair of sidewalls includes a pair of miter surfaces respectively converging from the first face and the second face to a lateral apex, the pair of sidewalls being symmetrically configured about the central longitudinal axis with respect to each other.

2. The wear plate according to claim 1, wherein the body defines at least two openings extending between the first face and the second face and being symmetrically positioned about the central longitudinal axis.

3. The wear plate according to claim 1, wherein the first face top end comprises a chamfer surface.

4. The wear plate according to claim 1, wherein the striated surface includes a series of convex segments extending along the central longitudinal axis and a series of concave segments extending along the central longitudinal axis and disposed in alternating relationship with the series of convex segments, the striated surface defining the series of first face channels, the series of first face channels corresponding to the series of concave segments.

5. The wear plate according to claim 1, wherein the series of first face channels extends from the first face bottom end along the central longitudinal axis for a predetermined distance.

6. The wear plate according to claim 1, wherein the second interface surface comprises a second striated surface defining a series of second face channels disposed in spaced relationship to each other along the transverse axis and extending along the central longitudinal axis.

7. The wear plate according to claim 6, wherein the series of first face channels is respectively aligned with the series of second face channels along the transverse axis.

8. The wear plate according to claim 6, wherein the series of first face channels is disposed in respective offset relationship with the series of second face channels along the transverse axis.

9. The wear plate according to claim 6, wherein each of the pair of sidewalls includes a pair of miter surfaces respectively converging from the first face and the second face to a lateral apex, the pair of sidewalls being symmetrically configured about the central longitudinal axis with respect to each other.

10. The wear plate according to claim 9, wherein the body defines at least two openings extending between the first face and the second face and being symmetrically positioned about the central longitudinal axis.

11. The wear plate according to claim 9, wherein each of the pair of miter surfaces is in perpendicular relationship with respect to each other.

12. A wear plate for a demolition hammer having a housing and a power cell, the wear plate for being interposed between the housing and the power cell, the wear plate comprising a body defining a central longitudinal axis and including:

a first face, the first face including a first face bottom end, a first face top end in spaced relationship to the first face bottom end along the central longitudinal axis, and a pair of first face lateral edges in spaced relationship to each other along a transverse axis that is perpendicular to the central longitudinal axis;

a second face, the second face including a second face bottom end, a second face top end in spaced relationship to the second face bottom end along the central longitudinal axis, and a pair of second face lateral edges in spaced relationship to each other along the transverse axis, the first face and the second face being in spaced relationship to each other along a normal axis that is mutually perpendicular to the central longitudinal axis and the transverse axis; and a pair of sidewalls, the pair of sidewalls respectively extending between the pair of first face lateral edges of the first face and the pair of second face lateral edges of the second face;

wherein the first face includes a first interface surface, the first interface surface defining at least one first face channel extending along the central longitudinal axis;

wherein the second face includes a second interface surface, the second interface surface defining at least one second face channel extending along the central longitudinal axis;

wherein each of the pair of sidewalls includes a pair of miter surfaces respectively converging from the first face and the second face to a lateral apex, the pair of sidewalls being symmetrically configured about the central longitudinal axis with respect to each other.

13. The wear plate according to claim 12, wherein the first interface surface comprises a first striated surface defining a series of first face channels disposed in spaced relationship to each other along the transverse axis and extending along the central longitudinal axis, and the second interface surface comprises a second striated surface defining a series of second face channels disposed in spaced relationship to each other along the transverse axis and extending along the central longitudinal axis.

14. The wear plate according to claim 13, wherein the body defines at least two openings extending between the first face and the second face and being symmetrically positioned about the central longitudinal axis.

* * * * *